United States Patent [19]

Vartoukian

[11] 4,186,673

[45] Feb. 5, 1980

[54] MATERIAL FEED MECHANISM FOR SEWING MACHINES

[75] Inventor: Artin G. Vartoukian, Roselle Park, N.J.

[73] Assignee: Singer Company, The, New York, N.Y.

[21] Appl. No.: 952,901

[22] Filed: Oct. 19, 1978

[51] Int. Cl.[2] ..... D05B 21/00; D05C 9/04; G05B 19/32

[52] U.S. Cl. ..... 112/121.15; 112/114; 318/575; 269/56

[58] Field of Search ..... 112/103, 121.15, 121.26, 112/114, 121.12, 102; 318/571, 574, 575, 576; 269/56

[56] References Cited

U.S. PATENT DOCUMENTS

| | | | |
|---|---|---|---|
| 2,876,650 | 3/1959 | Sangster | 112/121.15 |
| 3,143,791 | 8/1964 | Lanahan et al. | 269/56 |
| 3,490,398 | 1/1970 | Anniel | 112/121.15 |
| 3,538,315 | 11/1970 | Reuteler | 318/571 |
| 3,830,175 | 8/1974 | Levor | 112/121.12 |
| 3,980,033 | 9/1976 | Frost et al. | 112/121.15 X |
| 4,002,129 | 1/1977 | Kraatz | 112/121.15 |
| 4,079,681 | 3/1978 | Bianchi | 112/121.15 |
| 4,114,545 | 9/1978 | Manabe et al. | 112/121.15 |

*Primary Examiner*—Werner H. Schroeder
*Assistant Examiner*—Andrew M. Falik
*Attorney, Agent, or Firm*—Robert E. Smith; Edward L. Bell

[57] ABSTRACT

A low inertia drive mechanism is disclosed for imparting translational movement to a sewing machine fabric clamp. The drive mechanism comprises a first and second rigid tables mounted on guide rods for independent translational movements in mutually perpendicular straight paths. The second table carries a pair of transverse rods on which a third rigid table is slidably mounted which may move in any direction in a plane parallel to the planes of said first and second tables. The drive mechanism also comprises stationary motors not carried by any of the tables for imparting reciprocatory motion to the first and second rigid tables. The mechanism further includes means for connecting the fabric clamp to the third rigid table.

Also disclosed is a fabric clamp for supporting and guiding fabric for use with a variable translation fabric feeding mechanism. The clamp comprises upper and lower supporting structures, a flat plate extending from the lower supporting structure and having a cutout in its interior portion of a size and shape slightly larger than the pattern to be sewn. The clamp further comprises an upper clamp plate which includes a rigid open frame pivotably mounted at two diagonally opposed corners; the opening in said open frame being about the same size and shape as the cutout in the lower flat plate.

9 Claims, 5 Drawing Figures

MATERIAL FEED MECHANISM FOR SEWING MACHINES

BACKGROUND OF THE INVENTION

The instant invention relates to the field of sewing machines, and particularly to industrial sewing machines for use in specialized operations.

Both special purpose and general purpose sewing machines are well known in the prior art. General purpose sewing machines are machines characterized as being capable of basically straight stitching, with patterns and the like being created through the use of such machines by manually manipulating the material as desired to result in the desired stitching. Such machines may include adjustments for determining the length and other characteristics of the stitch, though all such machines are intended for manual guidance and manipulation of the material as well as manual control of the machine operation to achieve the desired end result.

The special purpose machines are generally machines for semi-automatically achieving the desired stitch without the attendant manual manipulation of the material. Certain machines of this type are referred to as tackers, which may be used to sew pockets, buttonholes and the like, merely by placing the material at a predetermined starting position with respect to the needle and activating the sewing machine, whereby the machine will cause the material to generally advance through a predetermined path to create the stitch desired.

Prior art special purpose machines as are commonly in use have certain undesirable characteristics. Since they must not only sew but trace out variable patterns depending upon some variable pattern determining means, such machines are generally more expensive than ordinary sewing machines and are limited to certain predetermined operations. They cannot be used for general sewing purposes. Consequently, such machines represent a substantial investment in equipment which is not available for general use and can only be justified in those instances where a sufficient use of such machines can be made. Also, in the prior art special purpose machines, the means for determining the pattern to be sewn is comprised of a changeable cam system, generally located under the machine. Accordingly, a special cam, itself being relatively expensive, must be made for each different pattern to be sewn by the machine. Furthermore, the cam system is generally buried within the mechanical assemblage of the machine so that the changing of cams requires a substantial amount of time of a skilled mechanic, representing a substantial cost in the cam mechanic's time and the loss of use of the machine while a change is being effected.

There is thus a need for a system whereby the function of a special purpose machine may be achieved, preferably by an attachment to a conventional machine, whereby variations in the pattern sewn may readily be achieved by the operator as desired, where the fabric is firmly grasped so as to be caused to accurately move to traverse the predetermined pattern, and whereby the machine may be used for general sewing requirements when not in use for special purposes.

It is known to convert conventional sewing machines to perform specialized operations heretofore only achievable on special machines. A clamp system clamps the fabric in functional disposition with respect to the needle of the sewing machine, with a two dimensional drive system having orthogonal tables advancing the fabric clamp and thereby the fabric through a predetermined pattern so as to automatically sew buttonholes, pockets and the like. The two dimensional drive system is actuated by means of a stepper motor operative when the needle is withdrawn from the material so as to incrementally step the fabric between stitching cycles, thereby allowing the fabric to remain stationary while each stitch is being made. For this purpose, a sensor is provided on the sewing machine to synchronize the fabric advance system with the sewing machine operation. The sensor provides a signal to a conventional logic and servo system.

Special purpose industrial sewing machines operating at high speeds, such as 3000 or more stitches per minute, impose severe system requirements for quality sewing. Experience has shown that none of the prior art clamping and two dimensional driving systems are capable of meeting the severe system requirements for quality sewing, primarily for lack of structural rigidity and excessive inertia forces present in the system. The excessive inertia forces come about basically due to the fact that at least one of the drive motors is mounted on one of the orthogonal tables, and that the motor required to drive such a table is large, generally weighing in excess of ten pounds. The instant invention overcomes the problems of the prior art clamping and two dimensional driving systems by providing a novel clamp and a low inertia, two dimensional driving system which eliminates the need for one of the drive motors to be mounted on one of the orthogonal tables.

SUMMARY OF THE INVENTION

The instant invention provides a low inertia drive mechanism for imparting variable translational movement to a fabric clamp used for supporting and guiding fabric to be sewn in cooperative disposition with respect to the needle of a sewing machine. The low inertia drive mechanism comprises a first, rigid table mounted for translation in a first straight path on a first pair of fixed rods, and a second, rigid table mounted for translation independent of the first table in a second straight path perpendicular to the first straight path on a second pair of fixed rods, the second table having a pair of transverse rods each of which is rigidly mounted on a side of the second table perpendicular to the second pair of fixed rods. The drive mechanism further comprises a third, rigid table slidably mounted on the transverse rods, and means for imparting the translational movement of the first table to said third table, whereby the third table may move in any direction in a plane parallel to the planes of the first and second tables. The low inertia drive mechanism also includes a first, stationary motor not carried by any of the tables for imparting reciprocatory motion to the first rigid table, and a second, stationary motor not carried by any of the tables for imparting reciprocatory motion to the second, rigid table. The low inertia drive mechanism also includes means for connecting the fabric clamp to the third, rigid table.

The instant invention also provides a fabric clamp for supporting and guiding fabric to be sewn in cooperative disposition with respect to the needle of a sewing machine, for use with a variable translation fabric feeding mechanism. The clamp comprises a lower supporting structure, an upper supporting structure rigidly connected to the lower supporting structure, a lower, flat plate extending from the lower supporting structure and having a cutout in its interior portion of a size and shape slightly larger than the pattern to be sewn. The clamp further comprises an upright section connected in vertically slidable fashion to the end of the upper supporting structure nearest the sewing machine, and an upper clamp plate having a fork-shaped section which is fixedly secured to the upright section. The upper clamp plate also includes a rigid, open frame pivotably mounted at two, diagonally opposed corners to the ends of the fork-shaped section, the opening in said open frame being about the same size and shape as the cutout in the lower, flat plate.

DESCRIPTION OF THE PREFERRED EMBODIMENT

Figure 3:
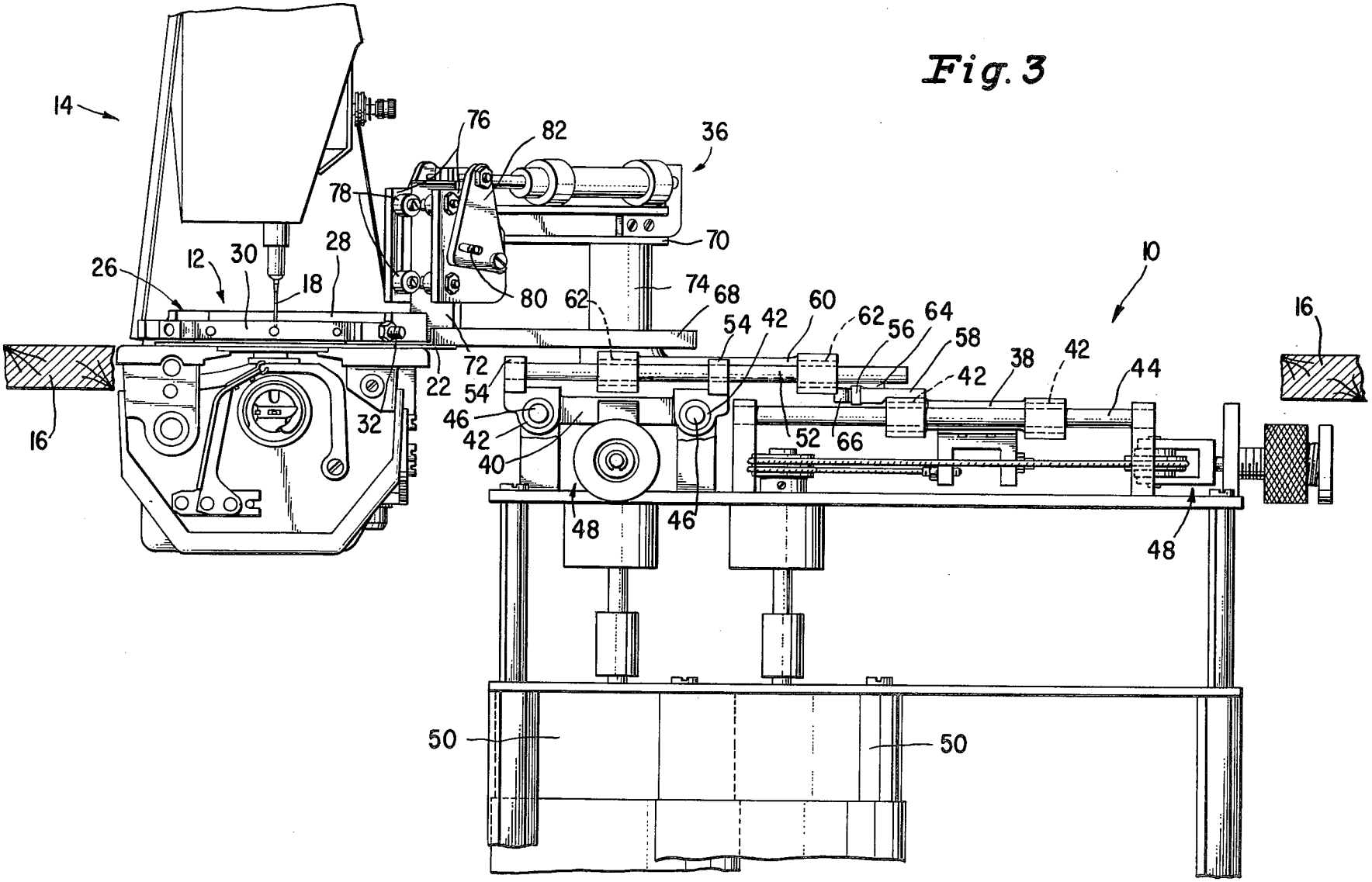
FIG. 3 is a front elevational view of the sewing machine, low inertia drive mechanism and fabric clamp shown in FIG. 2.

In describing the preferred embodiment of the instant invention, reference is made to the drawings, wherein FIG. 3 illustrates the low inertia drive mechanism generally designated 10 and a fabric clamp generally designated 12 mounted thereon for use with a general purpose industrial sewing machine generally designated 14. The sewing machine 14 is provided with a conventional table 16, an endwise reciprocatory needle 18, as well as a conventional head, arm, standard, and drive means. In normal operation, the material being sewn is advanced in synchronism with the motion of the needle 18 by the cooperative action of an engaging member below the needle and facing upward, and a second member holding the fabric downward against the engaging member.

Figure 4:
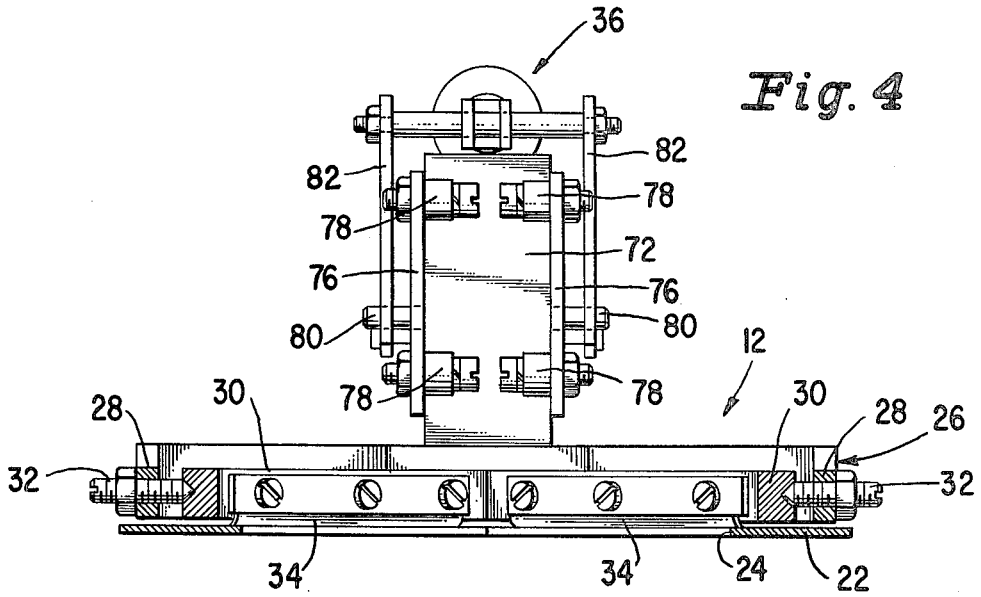
FIG. 4 is an enlarged, sectional view taken on the vertical plane indicated by the line 4—4 in FIG. 2.
Figure 5:
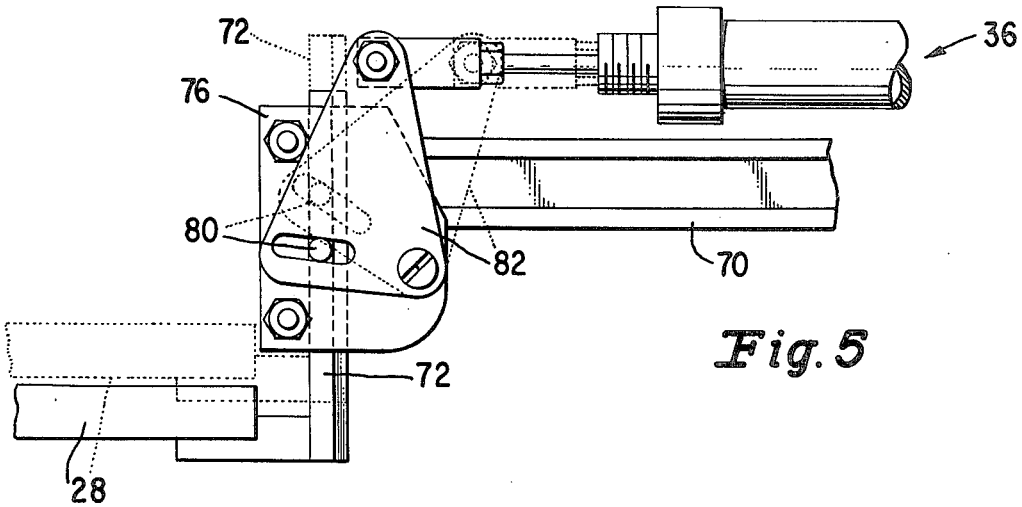
FIG. 5 is an enlarged, side elevational view of the actuating means for the fabric clamp.

In accordance with the present invention, the fabric clamp 12 clamps and advances the material with respect to the needle operation in the desired manner. The fabric clamp 12, which is further illustrated in FIG. 4, is provided with a lower, flat plate 22 having a cutout 24 in its interior portion which is slightly larger than the pattern to be sewn. The fabric clamp 12 also includes an upper clamp plate 26 having a fork-shaped section 28 and a rigid, open, square frame 30 pivotably mounted by means of two cone point set screws 32 at two, diagonally opposite corners to the ends of the fork-shaped section 28. The open frame 30 is thus held in place in a free pivoting manner, thereby allowing for a variable thickness in the fabric to be sewn. The opening in the rigid open frame 30 is about the same size and shape as the cutout 24 in the lower flat plate 22. Extending downwards from each of the four sides of the rigid open frame 30 are flexible plastic sheets 34 having an outward bend. The preferred material for the flexible plastic sheets 34 is Mylar, a trade name for Dupont's polyester film.

The fabric clamp 12 is adapted for ease of operation through a compressed air actuated cylinder assembly 36, which may be actuated by means of compressed air for automatic opening and closing of the fabric clamp 12.

Figure 1:
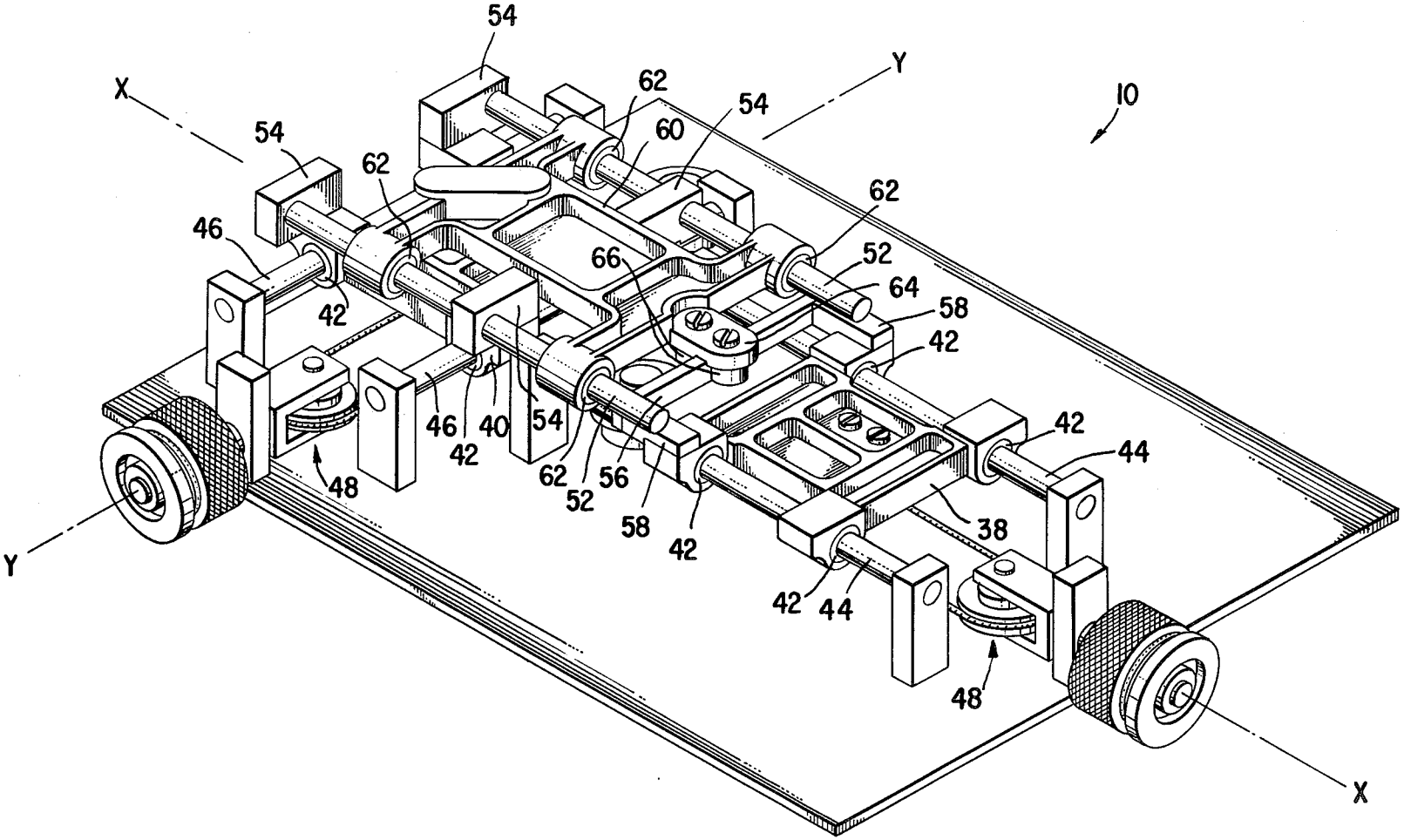
FIG. 1 is a perspective view of the low inertia drive mechanism according to the instant invention.
Figure 2:
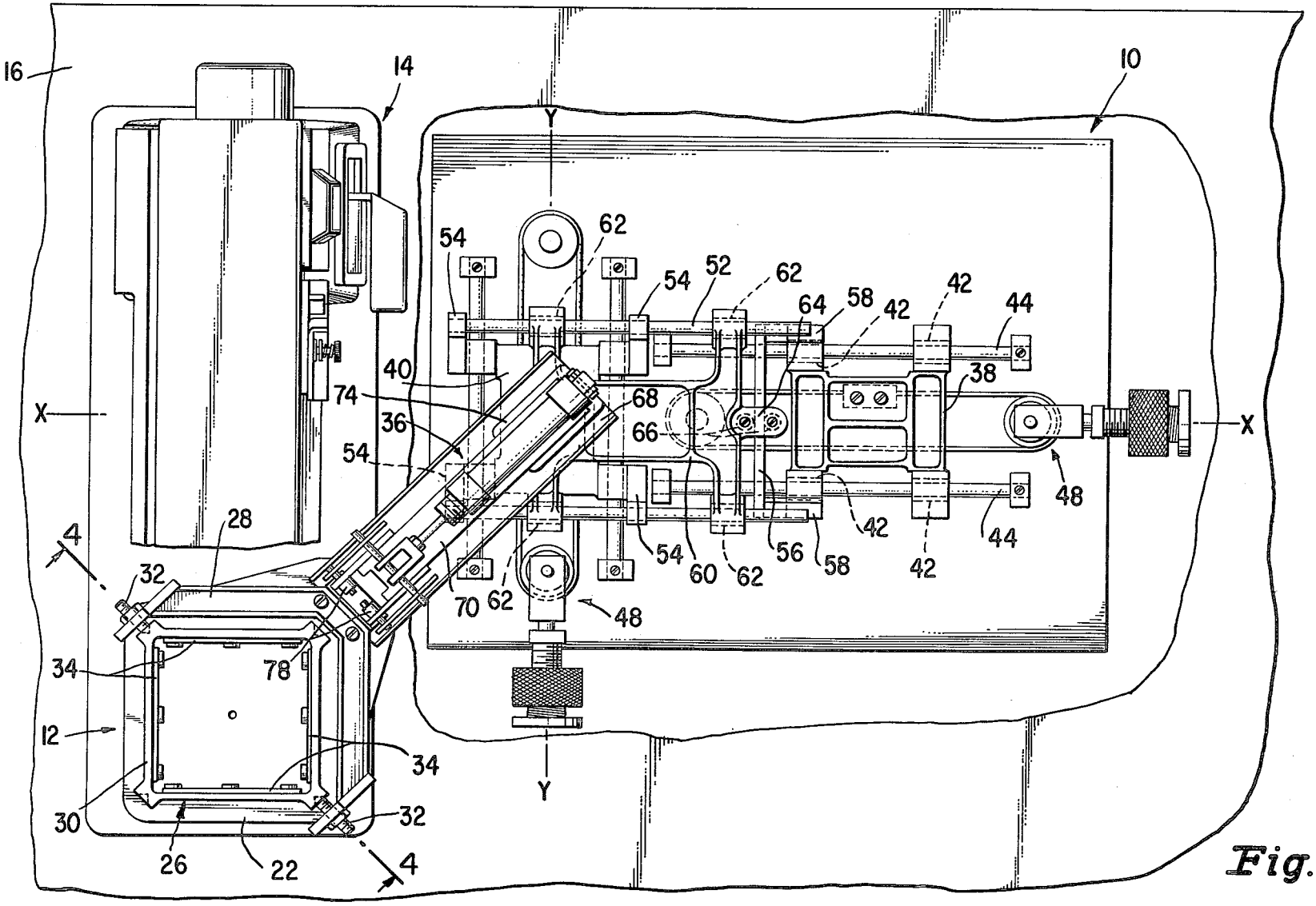
FIG. 2 is a top, plan view of a sewing machine, the low inertia drive mechanism and the fabric clamp according to the instant invention.

Having discussed the fabric clamp structure, we now turn our attention to the low inertia drive mechanism 10 which imparts a variable translational movement to the fabric clamp 12. The low inertia drive mechanism 10 is best seen in FIG. 1 wherein there is shown a first, rigid table 38 and a second, rigid table 40 which are identical, lightweight, yet extremely rigid aluminum castings, with four linear ball bushings 42 fitted onto each casting. The first rigid table 38 is mounted for translation along the X—X axis on a first pair of fixed rods 44 journalled within its bushings 42 while the second table 40 is mounted for translation independent of the first table 38 along the Y—Y axis on a second pair of fixed rods 46 journalled within its bushings 42. Thus, the path of the first table 38 is perpendicular to the path of the second table 40. The back and forth linear motion of each of the tables 38 and 40 is accomplished through a separate preloaded, positive cable/pulley drive system 48 each of which is operated by an individual stationary, servomotor 50 with incremental rotational capability. It is critical to the success of the instant invention that none of the motors be mounted on any of the rigid tables. Otherwise, the inertia of the system will be too great and quality sewing will not be realized.

The second rigid table 40, being the table which moves parallel to the Y—Y axis, in addition has a pair of rods 52 each rigidly mounted above it, in a transverse manner, by means of four brackets 54, such that no relative motion exists between the rods 52 and the Y—Y axis table 40.

The first rigid table 38, which moves parallel to the X—X axis, has a flat guide bar 56 rigidly mounted to it, off one side, in a transverse manner, by means of two brackets 58 so that no relative motion exists between the guide bar 56 and the first rigid table 38.

A third rigid table 60 is incorporated into the drive mechanism 10 and functions to translate the motion of the first two rigid tables 38 and 40 into a resultant direction. The translating, third rigid table 60 is a lightweight, yet rigid aluminum casting having four linear ball bushings 62 fitted into it which slide on the two rigidly mounted transverse rods 52 and an extension 64 from one side thereof for mounting a pair of spaced rollers 66 which sandwich the flat guide bar 56 extending from the first rigid table 38.

Each of the tables must be structurally rigid and be as light as possible. Stated another way, it is desirable to maximize the natural frequency of the system, natural frequency being defined as $$\sqrt{\frac{\text{stiffness of structure}}{\text{mass of material}}}\ .$$

The operation of the tables is such that as the second rigid table 40 slides along its guided direction, assuming the first rigid table 38 is at rest, the third rigid translating table 60 will be carried along with it in that direction, with no opposition from the first rigid table 38, due to the sliding action between the two spaced rollers 66 and the flat guide bar 56. Similarly, as the first rigid table 38 slides along its guided direction, assuming the second rigid table 40 is at rest, the third rigid translating table 60 will be pushed or pulled along with it in that direction with no opposition from the second rigid table 40, due to the sliding action between the transversely mounted rods 52 and the ball bushings 62. Consequently, a simultaneous movement of both the first and second tables 38 and 40 will allow the third translating table 60 to move in a corresponding resultant direction.

As best seen in FIG. 3 the fabric clamp 12 is mounted directly onto the third translating table 60 at at 45 degree inclination to the first and second tables 38 and 40 and extends toward the needle 18 of the sewing machine 14 together with the lower flat plate 22 and upper clamp plate 26 which are used for clamping the fabric. The clamp 12 also includes a lower supporting structure 68 and an upper supporting structure 70 rigidly connected thereto through column 74. At the end of the upper supporting structure 70 nearest the needle 18 are a pair of lateral plates 76 in which are journalled four rollers 78. An upright section 72 of the clamp 12 extends vertically upward from the fork-shaped section 28 and slides vertically up and down between the plates 76 and between the rollers 78 and the end of the upper supporting structure 70. A pair of pins 80 extend laterally from each side of the upright section 72. The cylinder assembly 36 actuates the slidable upright section 72 by means of a pair of pivotably mounted plates 82 which raise and lower the pins 80, thereby raising and lowering the upper clamp plate 26.

In operation, fabric is held between the lower flat plate 22 having the cutout 24 in the needle area and resting on a stainless steel plate mounted on the table 16 and the upper clamp plate 26. Upon application of a clamping force through the compressed air actuated cylinder assembly 36, the fork-shaped section 28 of the upper clamp plate 26 starts sliding downward, bringing the flexible, plastic sheets 34 into contact with the fabric surface. Continued downward motion of its fork-shaped section 28 causes the flexible, plastic sheets 34 to bend further outwards, thus stretching fabric in all four directions and creating a drum tight surface condition ready for sewing.

It will be understood by those skilled in the art that various changes in form and details may be made therein without departing from the spirit and scope of the present invention.

I claim:

1. A low inertia drive mechanism for imparting variable translational movement to a fabric clamp used for supporting and guiding fabric to be sewn in cooperative disposition with respect to the needle of a sewing machine, said mechanism comprising:

a first, rigid table mounted for translation in a first straight path on a first pair of fixed rods;

a second, rigid table mounted for translation independent of said first table in a second straight path perpendicular to said first straight path on a second pair of fixed rods, said second table having a pair of transverse rods each of which is rigidly mounted on a side of said second table perpendicular to said second pair of fixed rods;

a third, rigid table slidably mounted on said transverse rods;

means for imparting the translational movement of the first table to the third table whereby said third table may move in any direction in a plane parallel to the planes of said first and second tables;

a first stationary servomotor not carried by any of said tables for imparting reciprocatory motion to said first rigid table;

a second stationary sermomotor not carried by any of said tables for imparting reciprocatory motion to said second, rigid table; and means for connecting said fabric clamp to said third rigid table.

2. The drive mechanism of claim 1, wherein the reciprocatory motion imparted to the first and second tables is accomplished through a preloaded, positive cable/-pulley drive system.

3. The drive mechanism of claim 2, wherein the servomotors have incremental rotational capability.

4. The drive mechanism of claim 1, wherein each of the tables comprises a lightweight, aluminum casting.

5. The drive mechanism of claim 1, wherein the transverse rods are mounted above the second table.

6. The drive mechanism of claim 1, wherein each of the first two tables includes four linear ball bushings for sliding translation on the fixed rods.

7. The drive mechanism of claim 1, wherein the means for imparting the translational movement of the first table to the third table comprises a flat, guide bar rigidly mounted to one side of the first table perpendicular to said first pair of fixed rods and an extension from one side of the third table from which are mounted a pair of spaced rollers which sandwich the flat guide bar.

8. The drive mechanism of claim 7, wherein the third rigid table includes four linear ball bushings for the slidable mounting on the transverse rods.

9. In combination, a fabric clamp for supporting and guiding fabric to be sewn in cooperative disposition with respect to the needle of a sewing machine, and a low inertia drive mechanism for imparting variable translational movement to the fabric clamp, the combination comprising:

a first, rigid table mounted for translation in a first straight path on a first pair of fixed rods;

a second, rigid table mounted for translation independent of said first table in a second straight path perpendicular to said first straight path on a second pair of fixed rods, said second table having a pair of transverse rods each of which is rigidly mounted on a side of said second table perpendicular to said second pair of fixed rods;

a third, rigid table slidably mounted on said transverse rods;

means for imparting the translational movement of the first table to the third table, whereby said third table may move in any direction in a plane parallel to the planes of said first and second tables;

a first stationary servomotor not carried by any of said tables for imparting reciprocatory motion to said first rigid table;

a second stationary servomotor not carried by any of said tables for imparting reciprocatory motion to said second, rigid table;

a lower supporting structure rigidly secured to the third table;

an upper supporting structure rigidly connected to the lower supporting structure;

a lower, flat plate extending from the lower supporting structure and having a cutout in its interior portion of a size and shape slightly larger than the pattern to be sewn;

an upright section connected in vertically slidable fashion to the end of the upper supporting structure nearest the sewing machine needle; and an upper clamp plate having a fork-shaped section which is fixedly secured to the upright section, and a rigid, open frame pivotably mounted at two diagonally opposed corners to the ends of the fork-shaped section, the opening in said open frame being about the same size and shape as the cutout in the lower, flat plate.

* * * * *